US006726127B2

(12) United States Patent
Hofherr et al.

(10) Patent No.: US 6,726,127 B2
(45) Date of Patent: Apr. 27, 2004

(54) AIR ASSISTED LIQUID SPRAY NOZZLE ASSEMBLY

(75) Inventors: Christy Hofherr, Plainfield, IL (US); Kristy Wuehler Tanner, Glendale Heights, IL (US)

(73) Assignee: Spraying Systems Co., Wheaton, IL (US)

( * ) Notice: Subject to any disclaimer, the term of this patent is extended or adjusted under 35 U.S.C. 154(b) by 265 days.

(21) Appl. No.: 09/992,276

(22) Filed: Nov. 14, 2001

(65) Prior Publication Data

US 2003/0089798 A1 May 15, 2003

(51) Int. Cl.[7] ..... B05B 7/06

(52) U.S. Cl. ..... 239/432; 239/434; 239/521; 239/523; 239/601

(58) Field of Search ..... 239/432, 434, 239/523, 521, 596, 524, 601, 176

(56) References Cited

U.S. PATENT DOCUMENTS 1,867,878 A * 7/1932 Covello ..... 239/523
2,352,130 A * 6/1944 Short et al. ..... 239/521
4,511,087 A * 4/1985 Matsumoto ..... 239/433
4,591,099 A 5/1986 Emory et al.
4,815,665 A 3/1989 Haruch
4,989,788 A * 2/1991 Bendig et al. ..... 239/432
6,036,116 A * 3/2000 Bui ..... 239/432

* cited by examiner

*Primary Examiner*—Dinh Q. Nguyen
(74) *Attorney, Agent, or Firm*—Leydig, Voit & Mayer, Ltd.

(57) ABSTRACT

An air assisted spray nozzle assembly, having particular utility in spraying liquid coolants in continuous metal casting systems, which is adapted for operation with substantially reduced air consumption. The nozzle body includes a pre-atomizing unit that has a relatively small sized pressurized air inlet, a liquid impingement post with a uniquely configured impingement face for enhancing liquid breakdown and intermixing with a pressurized air stream from the air inlet, and an expansion chamber configured to reduce eddy currents that detract from efficient pre-atomization of the liquid. The spray nozzle further includes an elongated spray tip supporting barrel adapted for releasable mounting in the pre-atomizing head in predetermined rotational orientation relative to its longitudinal axis for properly receiving and supporting a removable spray tip.

27 Claims, 4 Drawing Sheets

AIR ASSISTED LIQUID SPRAY NOZZLE ASSEMBLY

FIELD OF THE INVENTION

The present invention relates generally to spray nozzles, and more particularly, to air assisted spray nozzles assemblies having particular utility for spraying liquid coolants in metal casting operations.

BACKGROUND OF THE INVENTION

In metal casting operations, and particularly continuous metal casting systems in which steel slabs, billets, or other metal shapes are extruded from a mold, it is necessary to spray the emerging metal with liquid coolant, namely water, for rapid heat removal. It is desirable that the spray be finely atomized and uniformly directed onto the metal for uniform cooling. Uneven distribution of the liquid coolant results in non-uniform cooling of the metal, which can cause cracking, high stresses, and reduced surface and edge quality. To facilitate liquid particle break down and distribution, it is known to use pressurized air assisted liquid spraying systems. U.S. Pat. No. 5,491,099, assigned to the same assignee as the present application, discloses an air assisted spray nozzle assembly that has been effectively used in continuous casting operations.

In continuous metal casting systems, the cast metal shape commonly is formed in a vertically oriented mold and then withdrawn through a series of closely spaced support rollers where its direction is changed from vertical to horizontal. A plurality of the coolant directing spray nozzles are disposed between each pair of rollers. Due to the large number of spray nozzles that must be employed in such cooling system, a large amount of pressurized air is consumed, which requires costly high capacity air compressors. Heretofore, efforts to reduce air consumption has adversely affected atomization of the coolant liquid and the uniformity of its application on the surface of the cast metal.

The close spacing of the cast metal support rollers creates further problems with such liquid coolant spraying systems. Prior spray nozzle assemblies, such as disclosed in applicant's above-referenced U.S. Pat. No. 4,591,099, have a nozzle body with an elongated barrel or tube which supports a spray tip between the closely spaced support rollers in close proximity to the moving cast metal such that a flat spray pattern is precisely oriented parallel and between the support rollers. Since the spray tip must be precisely oriented to achieve proper orientation of the flat spray pattern, fixing the elongated spray tip supporting barrel to the nozzle body during manufacture, such as by welding, can be tedious and expensive. Moreover, if a portion of the nozzle assembly is damaged or excessively worn during usage, it is necessary to replace the entire spray nozzle assembly which also can be costly.

OBJECTS AND SUMMARY OF THE INVENTION

It is an object of the present invention to provide a cast metal liquid coolant spray system having air assisted spray nozzles adapted for more efficient and economical usage.

A further object is to provide an air assisted spray nozzle assembly which is operable for producing a discharging flat spray pattern with a high degree of atomization and uniform distribution while requiring substantially reduced air consumption.

A further object is to provide a spray nozzle assembly as characterized above which has a pre-atomizing section designed for more efficient and effective liquid particle breakdown prior to direction through the elongated barrel and downstream spray tip.

Still another object is to provide a spray nozzle assembly of the foregoing type having a pre-atomizing section which minimizes eddy current losses during liquid pre-atomization from converging pressurized air and liquid flow streams.

Yet another object is to provide a spray nozzle assembly of the above kind that is relatively simple in construction and lends itself to economical manufacture and field repair.

A related object is to provide such a spray nozzle assembly in which the elongated spray tip supporting barrel may be easily assembled on the nozzle body while ensuring proper orientation of the spray tip, and hence, proper direction of the discharging flat spray pattern.

Another object is to provide a spray nozzle assembly of such type in which the spray tip support barrel is adapted for easy field repair or replacement.

Other objects and advantages of the invention will become apparent upon reading the following detailed description and upon reference to the drawings, in which:

Figure 1:
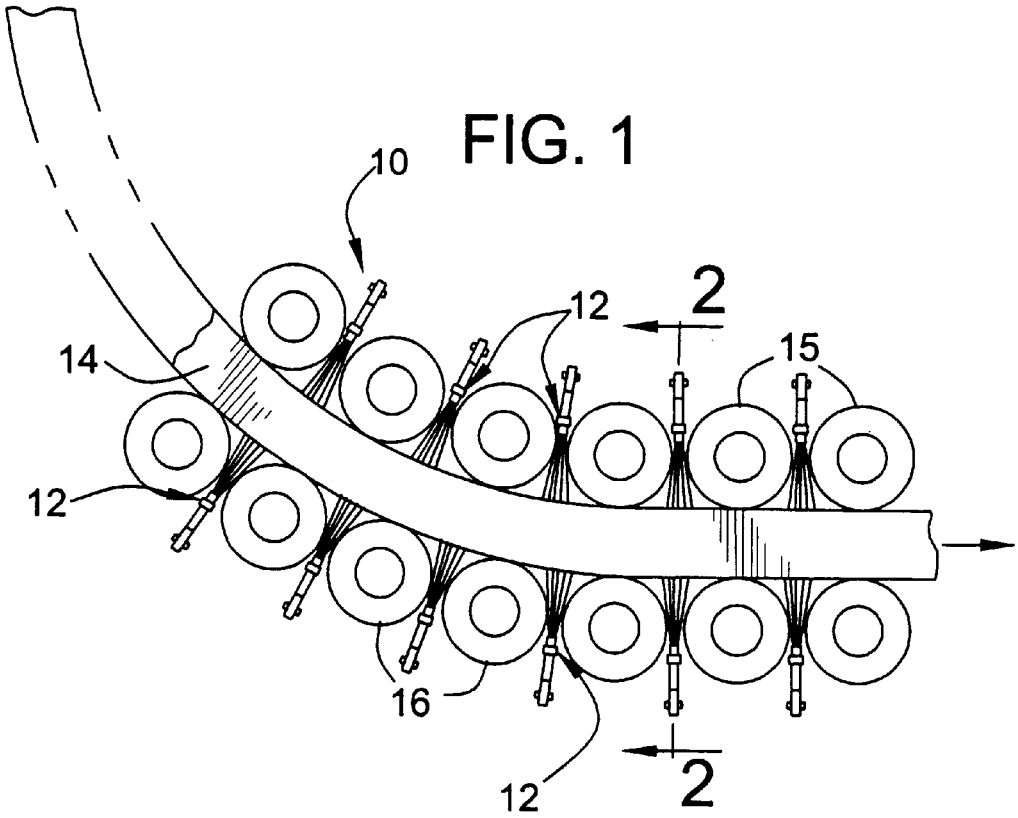
FIG. 1 is a side elevational view of a continuous metal casting apparatus having a spraying system with spray nozzle assemblies in accordance with the present invention.
Figure 2:
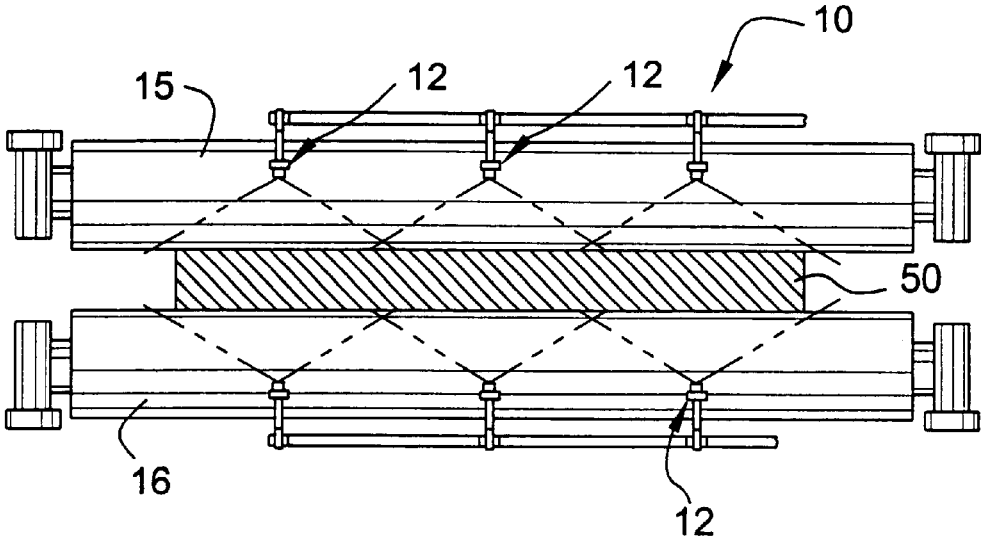
FIG. 2 is a transverse section taken in the plane of line 2—2 in FIG. 1.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative continuous metal casting apparatus having a spraying system 10 with air assisted liquid spray nozzle assemblies 12 embodying the invention. The continuous casting apparatus may be of a known type, including a continuous casting mold (not shown) from which a metal shape, in this instance in the form of slab 14, is extruded. The slab 14 in this case emerges from the continuous caster and is transitioned from the vertical to a horizontal orientation by means of parallel sets of guide rollers 15, 16 rotatably supported on opposite sides of the emerging metal shape. A plurality of the spray nozzle assemblies 12 are supported in respective rows between each pair of rollers 15, 16 for directing a flat spray pattern of coolant, namely water, onto opposite surfaces of the moving metal shape 14. As is known in the art, the spray nozzle assemblies 12 may be supported by suitable means, which may include the appropriate piping for supplying necessary pressurized air and water for their operation. Since each spray nozzle assembly 12 is similar in construction, only one need be described in detail.

Figure 3:
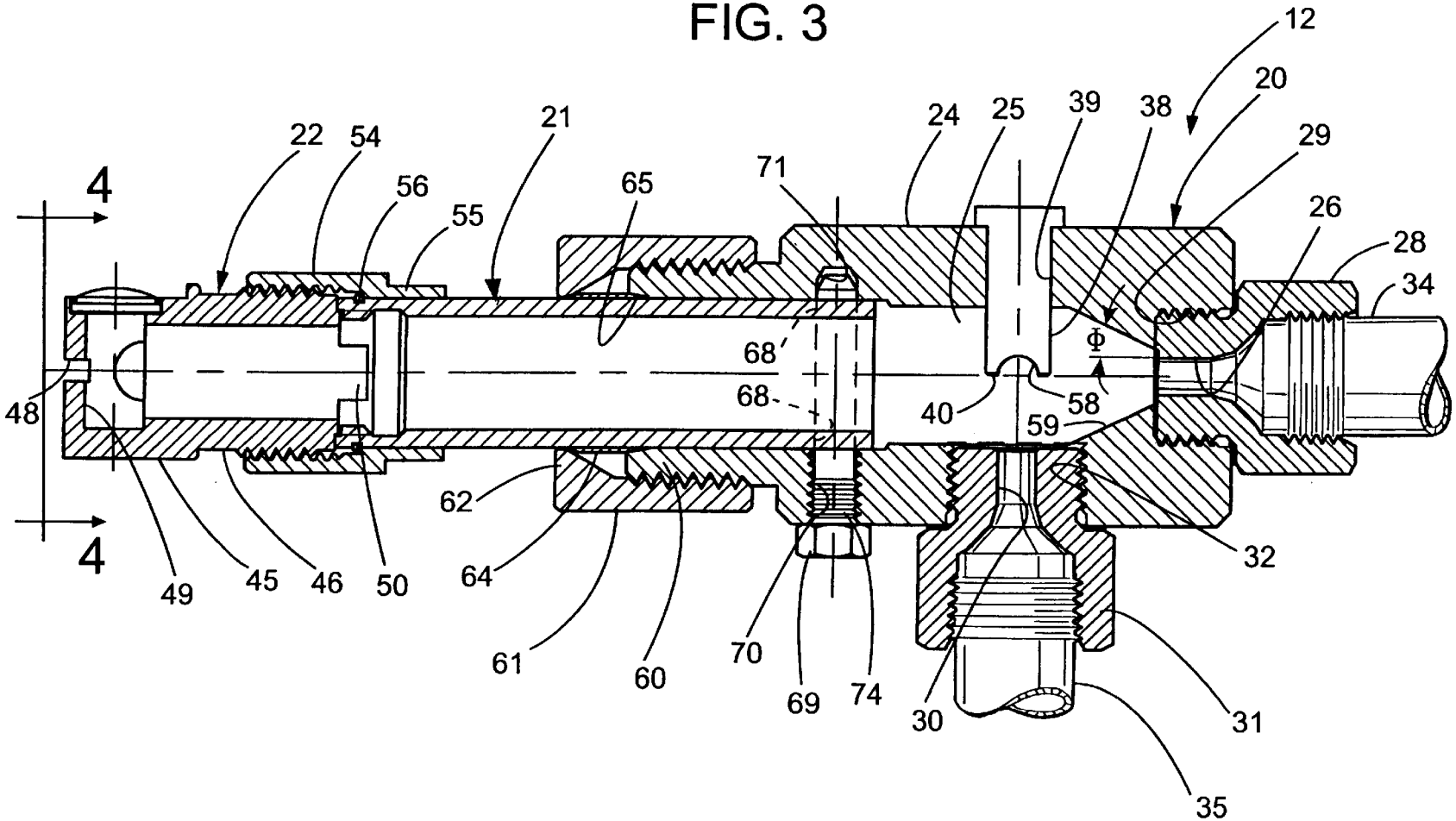
FIG. 3 is an enlarged longitudinal section of one of the spray nozzle assemblies of the illustrated spraying system.
Figure 4:
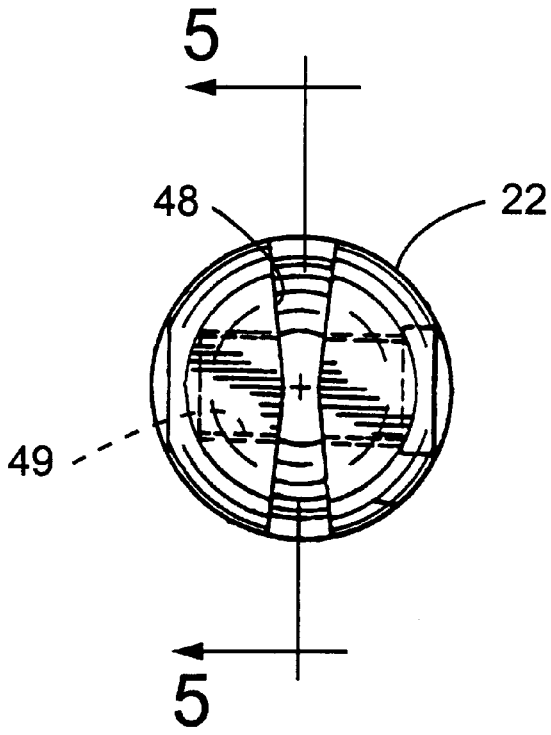
FIG. 4 is an enlarged discharge end view showing the spray tip of the illustrated spray nozzle assembly taken in the plane of line 4—4 in FIG. 3.
Figure 5:
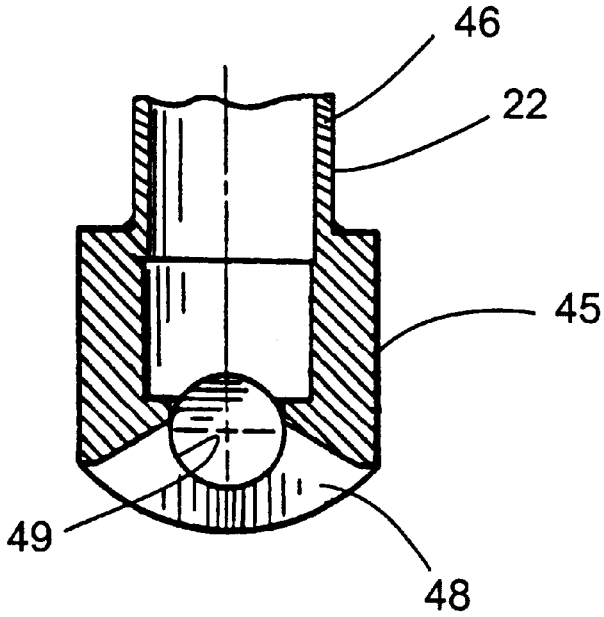
FIG. 5 is a fragmentary longitudinal section of the spray tip, taken in the plane of line 5—5 in FIG. 4.

Each spray nozzle assembly 12, as best depicted in FIG. 3, comprises a preliminary liquid atomizing head or section 20, an elongated tubular barrel 21 connected at its upstream end to the atomizing head 20, and a spray tip 22 connected to the downstream end of the barrel 21. The atomizing head 20 comprises a hollow body 24 having an elongated expansion chamber 25 extending axially thereof, a pressurized air inlet 26 defined by an orifice fitting 28 in threaded engagement in an axial bore 29 in an upstream end of the body 24, and a liquid coolant inlet 30 communicating transversely with the expansion chamber defined by an orifice fitting 31 in threaded engagement with a radial bore 32 extending through a side wall of the body 24. The air inlet orifice fitting 28 is connected to a pressurized air supply line 34, and the liquid inlet orifice fitting 31 is coupled to a liquid coolant, preferably water, supply line 35. The atomizing head 20 further includes an impingement post 38 fixed, such as by a press fit, into a radial bore 39 in diametrically opposed relation to the liquid inlet 30. The impingement post 38 extends into the chamber 25 with an outer end 40 approximately on longitudinal axis of the body 24. Pressurized air and liquid air streams introduced through the liquid and air inlets 26, 30, respectively, converge in the atomizing head, pre-atomizing the liquid for direction through the barrel 21 and discharge from the spray tip 22.

The spray tip 22, which may be of a type disclosed in the aforementioned U.S. Pat. No. 4,591,099, the disclosure of which is incorporated herein by reference, is adapted to distribute pre-atomized liquid received from the pre-atomizing head 20, via the barrel 21, in a predetermined flat spray pattern. The illustrated spray tip 22 includes an orifice defining end 45 and an upstream hollow stem 46. The orifice defining end 45 has an elongated discharge aperture 48 formed by a cross slot through the end communicating with a transversely oriented cylindrical mixing chamber 49, which in turn communicates with the hollow stem 46.

Figure 6:
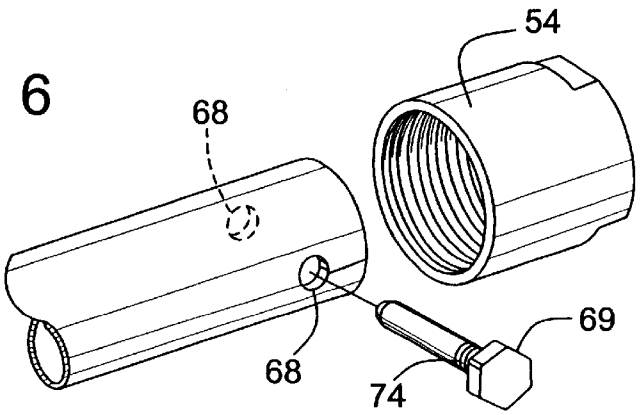
FIG. 6 is an exploded perspective and the spray tip and support barrel of the illustrated nozzle assembly.
Figure 7:
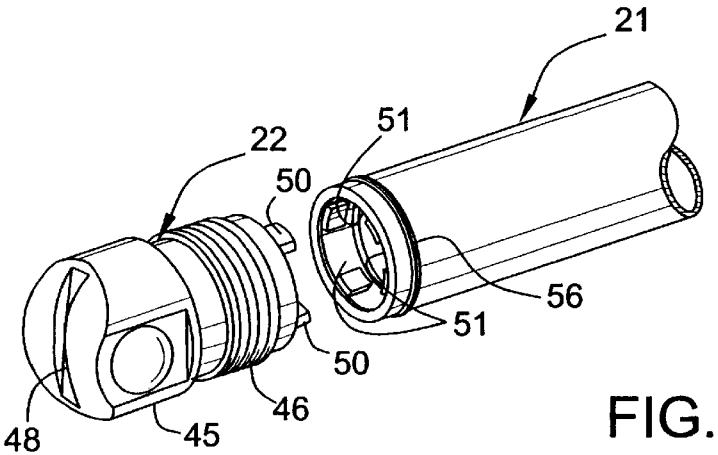
FIG. 7 is a perspective of the spray tip assembled on the support barrel.
Figure 7:
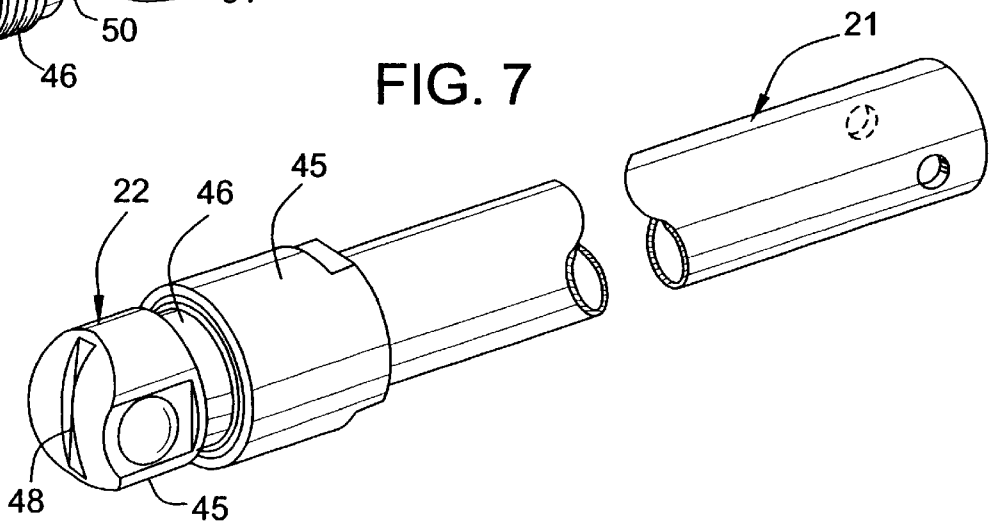

For mounting the spray tip 22 with the elongated discharge aperture 48 in predetermined angular relation to the barrel 21, the spray tip stem 46 is formed with a pair of diametrically opposed locating lugs 50 extending in an upstream direction for register with corresponding recesses 51 in a downstream end of the barrel 21 (FIG. 6). The illustrated barrel 21 has two pairs of lug-receiving recesses 51, offset 90° from each other, which enable the spray tip 22 to be mounted with the discharge orifice 48 oriented at either of two positions, 90° offset from each other, for the particular spray application.

For releasably securing the spray tip 22 to the barrel 21, the spray tip stem 46 has an externally threaded upstream end for engagement by an internally threaded annular retaining member 54 supported on a downstream end of the barrel 21 for rotational and axial movement. Threaded engagement of the retainer 54 with the spray tip stem 46 through rotation of the retainer 54 draws the upstream end of the spray tip 22 into fixed engagement with the downstream end of the barrel 21, with the lugs 50 and recesses 51 in appropriate registry. A reduced diameter upstream sleeve portion 55 of the retainer 54 in this instance is drawn against a snap ring 56 fixed about the barrel 21 adjacent its downstream end.

As is known in the art, a plurality of spray nozzle assemblies 12 may be supported in side-by-side relation between rows of support rollers 15, 16 such that the discharging flat spray patterns, which are oriented parallel to the rollers 15, 16, overlap slightly at the ends to facilitate uniform cooling of the moving cast metal. While prior art air assisted spray nozzles have been effectively used in cooling systems for continuous cast metal, as indicated above, due to the numerous nozzles that must be employed in such cooling systems, large amounts of pressurized air heretofore have been required for proper liquid atomization and distribution.

In accordance with an important aspect of the invention, the pre-atomizing heads of the spray nozzle assemblies of the present invention are designed to effect a high degree of liquid pre-atomization, while requiring substantially reduced air consumption. More particularly, the spray nozzle assembly of the present invention can be effectively used with pressurized air requirements reduced by as much as 30%. To this end, the air atomizing head has a relatively small size pressurized air inlet, the impingement post has a uniquely configured impingement face for enhanced liquid intermixing with the pressurized air stream, and the expansion chamber is configured to reduce eddy currents that detract from efficient pre-atomization of liquid in the expansion chamber. The combined effect is the substantially more efficient liquid atomization.

In carrying out the invention, the pre-atomizing head 20 of the illustrated spray nozzle assembly 12 has a pressurized air inlet 26 sized substantially smaller than the liquid inlet 30. Preferably, the pressurized air inlet has a diameter which is about between about 0.80 and 0.93 the diameter of the liquid inlet 30. The mixing and expansion chamber 25 has a diameter at least four times greater than the diameter of the air inlet orifice, and preferably between about 4.5 and 9.0 times greater than the diameter of the air inlet orifice. It will be appreciated that for a given inlet air pressure, the reduced sized air inlet itself reduces air consumption, while increasing velocity of the pressurized air stream introduced into the atomizing head.

In further keeping with the invention, the impingement post 38 has an inwardly radiused end face in the form of a semi-cylindrical recess 58 extending through the end of the impingement post in transverse relation to the air inlet 26 and the pressurized air stream axially directed into the expansion chamber 25 from the air inlet 26. The radiused recess 58 in this case has a center of curvature located approximately on the longitudinal axis of the body 24 and a width slightly greater than the diameter of the liquid inlet 30. The recess 58 effectively defines an outwardly directed U-shaped impingement surface on the end of the impingement post 38 in direct opposing relation to the liquid inlet. Pressurized liquid introduced through the liquid inlet 30 will impinge against the U-shaped impingement surface, break up, and reverse direction for enhanced contact by the pressurized air stream directed across the end of the impingement post for increased liquid particle breakdown and intermixing with the pressurized air stream.

In further carrying out the invention, the expansion chamber 25 of the atomizing head 20 is formed with a tapered entry communicating between the air inlet 26 and the impingement post 38 which eliminates eddy currents in an upstream end of the expansion chamber that can detract from efficient utilization of the incoming pressurized air stream. The expansion chamber 25 in this case has an upstream end defined by a frustoconical wall 59 which extends from a position adjacent the air inlet 26 and to a position adjacent the impingement post 38 at a relatively shallow acute angle Φ of about 25° to the longitudinal axis of the body. The frustoconical wall 59 substantially eliminates corner areas in the upstream end of the expansion chamber 25 in which eddy currents can be generated that do not effectively enhance intermixing of the introduced pressurized liquid and air streams. Instead, turbulent intermixture of the liquid and air occurs primarily in the vicinity of the impingement post 38 for maximum interaction and liquid break down. It will be appreciated that while the illustrated tapered entry comprises a frustoconical wall 59, alternatively, the tapered entry could have inwardly or outwardly curved walls, so long as upstream corners of the expansion chamber are eliminated.

In carrying out a further aspect of the invention, the barrel 21 is adapted for easy mounting in the pre-atomizing head 20 with the downstream locating recesses 51 in predetermined rotational orientation about its longitudinal axis for properly receiving and supporting the spray tip 22. In the illustrated embodiment, the upstream end of the barrel 21 is positioned within a downstream end of the atomizing head 22 for communication with the expansion chamber 25. For removably retaining the barrel 21 in assembled position, the atomizing head 20 has an externally threaded hub 60 at its downstream end that is engageable by an internally threaded annular retainer cap 61 mounted for slidable positioning on the barrel 21. The retainer cap 61 has a reduced diameter aperture which that defines an annular retaining flange 62 that, as an incidence to threaded advancement of the retaining cap 61 onto the hub 60, is drawn against an annular ferrule 64 mounted about the barrel 21 adjacent the end of the hub 60. The hub 60 in this case has an outwardly flared downstream opening 65 which receives a tapered upstream end of the ferrule 64 for creating a liquid seal therebetween.

For locating the barrel 21 in the atomizing head 20 in predetermined angular orientation about its longitudinal axis such that the elongated discharge orifice 48 of a spray tip 22 mounted on the barrel 21 is in predetermined orientation for properly directing a flat spray pattern, the upstream end of the barrel 21 is formed with a pair of aligned locating apertures 68 through which a removable retaining pin 69 is positioned from a side of the atomizing head body 24. For this purpose, the body 24 is formed with a pair of aligned passageways 70, 71. The passageway 70 communicates through a side of the body 24 on one side of the barrel 21 and is threaded for receiving a threaded shank portion 74 of the pin 66. The passage 71 on the opposite side of the barrel 21 receives a protruding unthreaded end of the pin 69. It will be appreciated that assembly of the pin 69 through the aligned apertures 68 of the barrel 21 not only angularly orients the barrel 21 relative to the atomizing head 20, but further retains the barrel 21 in mounted position. Removal of the pin and disengagement of the retaining cap 61, furthermore, enables quick and easy field removal and replacement of the barrel 21 that might be necessitated by reason of damage or wear to the barrel.

From the foregoing, it can be seen that a metal casting liquid coolant spray system having spray nozzle assemblies in accordance with the invention is adapted for more efficient and economical operation. The spray nozzle assemblies have atomizing heads designed for more effective liquid particle breakdown and distribution in a discharging flat spray pattern with substantially reduced pressure air consumption. The spray nozzle assembly, furthermore, is relatively simple in construction, permitting the spray tip supporting tubular barrel to be assembled in precise angular orientation to the atomizing head, while enabling easy field repair and replacement.

What is claimed is:

1. An air assisted spray nozzle comprising:

a hollow body having a mixing and atomizing chamber, an air inlet orifice through which a pressurized air stream is directed into said mixing and atomizing chamber, and a liquid inlet orifice through which a liquid stream is directed into said mixing and atomizing chamber at an angle to a direction of said pressurized air stream, an impingement post extending into said chamber, said post being in substantial alignment with said liquid inlet orifice and having an end face against which the liquid stream directed into said chamber from said liquid inlet orifice impinges, said post being disposed transversely to the direction of travel of said pressurized air stream directed into said chamber from said air inlet orifice, said impingement post end face being formed with an inwardly directed recess for receiving the liquid stream introduced into said chamber from said liquid inlet orifice and directing the liquid away from the end face for enhanced intermixing by the pressurized air stream introduced into said mixing and atomizing chamber from said air inlet for breaking down and atomizing of the liquid, and a spray tip having a discharge orifice in fluid communication with said mixing and atomization chamber and through which said atomized liquid is discharged in a predetermined spraying pattern.

2. The air assisted spray nozzle of claim 1 in which said recess has an inwardly curved configuration.

3. The air assisted spray nozzle of claim 1 in which said recess is radiused.

4. The air assisted spray nozzle of claim 1 in which said recess is in the form of a segment of a cylinder extending through the end of said impingement post in transverse relation to said air inlet.

5. The air assisted spray nozzle of claim 1 in which said recess defines an outwardly directed U-shaped impingement surface on the end face of said post in direct opposing relation to said liquid inlet.

6. The air assisted spray nozzle of claim 1 in which said mixing and atomizing chamber has an elongated configuration disposed in axial alignment with said air inlet orifice and said discharge orifice, and said liquid inlet orifice is disposed at an angle of about 90° to said inlet orifice.

7. The air assisted nozzle of claim 1 in which said air inlet orifice has a diameter less than the diameter of said liquid inlet orifice.

8. The air assisted nozzle of claim 1 in which said mixing and expansion chamber has a upstream end defined by a frustoconical wall section which tapers outwardly from a location adjacent said air inlet orifice to a location adjacent said impingement post for facilitating intermixture of said pressurized air and liquid streams in the vicinity of said impingement post.

9. The air assisted nozzle of claim 1 including an elongated tubular barrel in fluid communication with said mixing and expansion chamber, said spray tip being removably mounted in predetermined rotatably oriented relation to a downstream end of said barrel, said spray tip having a discharge orifice in fluid communication with said barrel and mixing and atomizing chamber through which said atomized liquid is discharged in a predetermined flat spray pattern, and a releasable fastener for removably securing said barrel to said body with said body in predetermined rotatably oriented relation to said body such that a spray tip secured to said barrel discharges a flat spray pattern in predetermined relation to said body.

10. An air assisted spray nozzle comprising:

a hollow body having a mixing and atomizing chamber, an air inlet orifice through which a pressurized air stream is directed into said mixing and atomizing chamber, and a liquid inlet orifice through which a liquid stream is directed into said mixing and atomizing chamber at an angle to a direction of said pressurized air stream, an impingement post extending into said chamber, said post being in substantial alignment with said liquid inlet orifice and having an end face against which said liquid stream directed into said chamber from said liquid inlet orifice impinges, said post being disposed transversely to the direction of travel of a said pressurized air stream directed into said chamber from said air inlet orifice, said air inlet orifice having a diameter of between about 0.80 and 0.93 the diameter of said liquid inlet orifice, said mixing and atomizing chamber having a diameter at least four times greater than the diameter of said air inlet orifice, and a spray tip having a discharge orifice in fluid communication with said mixing and atomization chamber and through which said atomized liquid is discharged in a predetermined flat spray pattern.

11. The air assisted nozzle of claim 10 in which said mixing and expansion chamber has a upstream end defined by a frustoconical wall section that tapers outwardly from a location adjacent said air inlet orifice to a location adjacent said impingement post for facilitating intermixture of said pressurized air and liquid streams in the vicinity of said impingement post.

12. The air assisted spray nozzle of claim 10 in which said impingement post end face is formed with an inwardly directed recess for receiving the liquid stream introduced into said chamber from said liquid inlet orifice and directing the liquid away from the end face for enhanced intermixing by the pressurized air stream introduced into said mixing and atomizing chamber.

13. The air assisted nozzle of claim 10 including an elongated tubular barrel in fluid communication with said mixing and expansion chamber, said spray tip being removably mounted in predetermined rotatably oriented relation to a downstream end of said barrel, said spray tip having a discharge orifice in fluid communication with said barrel and mixing and atomizing chamber through which said atomized liquid is discharged in a predetermined flat spray pattern, and a releasable fastener for removably securing said barrel to said body with said body in predetermined rotatably oriented relation to said body such that a spray tip secured to said barrel discharges a flat spray pattern in predetermined relation to said body.

14. An air assisted spray nozzle comprising:

a hollow body having a mixing and atomizing chamber, an air inlet orifice through which a pressurized air stream is directed into said mixing and atomizing chamber, and a liquid inlet orifice through which a liquid stream is directed into said mixing and atomizing chamber at an angle to a direction of said pressurized air stream, an impingement post extending into said chamber, said post being in substantial alignment with said liquid inlet and having an end face against which said liquid stream directed into said chamber from said liquid inlet orifice impinges, said post being disposed transversely to the direction of travel of said pressurized air stream directed into said chamber from said air inlet orifice, said mixing and expansion chamber having an upstream end defined by a frustoconical wall section that tapers outwardly from a location adjacent said air inlet orifice to a location adjacent said impingement post for facilitating intermixture of said pressurized air and liquid streams in the vicinity of said impingement post, and a spray tip having a discharge orifice in fluid communication with said mixing and atomization chamber and through which said atomized liquid is discharged in a predetermined spraying pattern.

15. The air assisted spray nozzle assembly of claim 14 in which said frustoconical wall section extends at an angle of about 25° to the longitudinal axis of said body.

16. The air assisted nozzle of claim 14 in which said air inlet orifice has a diameter less than the diameter of said liquid inlet orifice, and said impingement post end face is formed with an inwardly directed recess for receiving the liquid stream introduced into said chamber from said liquid inlet orifice and directing the liquid away from the end face for enhanced intermixing by the pressurized air stream introduced into said mixing and atomizing chamber.

17. A spraying system for directing a coolant liquid in a metal casting apparatus comprising a plurality of spray nozzles disposed in side-by-side relation to each other; each nozzle being operable for directing a flat spray pattern of cooling liquid onto a coverage area of a metal surface to be cooled with the coverage areas of discharge sprays of adjacent nozzles being in partially overlapping relation to each other; a source of pressurized liquid and a source of pressurized air; said nozzles each comprising a hollow body having a mixing and atomizing chamber, an air inlet orifice for connection to said pressurized air source; through which a pressurized air stream is directed into said mixing and atomizing chamber, and a liquid inlet orifice for connection to said pressurized liquid source through which a liquid stream is directed into said mixing and atomizing chamber at an angle to the direction of said pressurized air stream; an impingement post extending into said chamber; said post being in substantial alignment with said liquid inlet orifice and having an end face against which a liquid stream directed into said chamber from said liquid inlet orifice impinges; said post being disposed transversely to the direction of travel of a pressurized air stream directed into said chamber from said air inlet orifice;

an elongated tubular barrel in fluid communication with said mixing and expansion chamber, said spray tip being removably mounted in predetermined rotatably oriented relation to a downstream end of said barrel, said spray tip having a discharge orifice in fluid communication with said barrel and mixing and atomizing chamber through which said atomized liquid is discharged in a predetermined flat spray pattern, a releasable fastener for removably securing said barrel to said body with said body in predetermined rotatably oriented relation to said body such that a spray tip secured to said barrel discharges a flat spray pattern in predetermined relation to said body, said releasable fastener including a pin, said body being formed with a pin-receiving passage, and said fastener pin being removably positionable in said passage upon securement of the barrel to said body for rotatably orienting the barrel in predetermined angular relation to the body.

18. The spraying system of claim 17 in which pin is threadably engageable with said body pin receiving passage.

19. The spraying system of claim 17 in which said pin-receiving passage extends into said body from a side thereof.

20. The air assisted spray nozzle spraying system of claim 17 in which said pin passage extends on opposite sides of said tubular barrel.

21. The spraying system of claim 20 including a releasable retaining cap removably securing said barrel to said body.

22. The spraying system of claim 17 including an impingement post extending into said chamber, said post being in substantial alignment with said liquid inlet orifice and having an end face against which a liquid stream directed into said chamber from said liquid inlet orifice impinges, and said post being disposed transversely to the direction of travel of a pressurized air stream directed into said chamber from said air inlet orifice,

23. A spraying system for directing a coolant liquid in a metal casting apparatus comprising a plurality of spray nozzles disposed in side-by-side relation to each other; each nozzle being operable for directing a flat spray pattern of cooling liquid onto a coverage area of a metal surface to be cooled with the coverage areas of discharge sprays of adjacent nozzles being in partially overlapping relation to each other; a source of pressurized liquid and a source of pressurized air; said nozzles each comprising a hollow body having a mixing and atomizing chamber, an air inlet orifice for connection to said pressurized air source; through which a pressurized air stream is directed into said mixing and atomizing chamber, and a liquid inlet orifice for connection to said pressurized liquid source through which a liquid stream is directed into said mixing and atomizing chamber at an angle to the direction of said pressurized air stream; said air inlet orifice having a diameter less than the diameter of said liquid inlet orifice, an impingement post extending into said chamber; said post being in substantial alignment with said liquid inlet orifice and having an end face against which a liquid stream directed into said chamber from said liquid inlet orifice impinges; said impingement post being disposed transversely to the direction of travel of a pressurized air stream directed into said chamber from said air inlet orifice; said impingement post end face of each said spray nozzle being formed with an inwardly directed recess for receiving the liquid stream introduced into said chamber from said liquid inlet orifice and directing the liquid away from the end face for enhanced intermixing by the pressurized air stream introduced into said mixing and atomizing chamber; and a spray tip having a discharge orifice in fluid communication with said mixing and atomization chamber and through which said atomized liquid is discharged in a predetermined flat spray pattern.

24. The spraying system of claim 23 in which said mixing and expansion chamber of each spray nozzle has a tapered upstream end defined by a frustoconical wall section extending from a location adjacent said air inlet orifice to a location adjacent said impingement post for facilitating intermixture of said pressurized air and liquid streams in the vicinity of said impingement post.

25. The spraying system of claim 24 in which said air inlet orifice has a diameter of between 0.80 and 0.93 the diameter of said liquid inlet orifice, and said mixing and atomizing chamber has a diameter at least four times greater than the diameter of said air inlet.

26. The spraying system of claim 23 in which said recess is in the form of a segment of a cylinder extending through the end of said impingement post in transverse relation to said air inlet.

27. An air assisted spray nozzle comprising:

a hollow body having a mixing and atomizing chamber, a liquid inlet orifice through which a liquid stream is directed into said mixing and atomizing chamber, and an air inlet orifice through which a pressurized air stream is directed into said mixing and atomizing chamber at an angle to the direction of said liquid stream for intermixing with and atomizing said liquid stream, an elongated tubular barrel in fluid communication with said mixing and expansion chamber, said spray tip being removably mounted in predetermined rotatably oriented relation to a downstream end of said barrel, said spray tip having a discharge orifice in fluid communication with said barrel and mixing and atomizing chamber through which said atomized liquid is discharged in a predetermined flat spray pattern, and a releasable fastener for removably securing said barrel to said body with said body in predetermined rotatably oriented relation to said body such that a spray tip secured to said barrel discharges a flat spray pattern in predetermined relation to said body, said fastener including a pin, said body being formed with a pin-receiving passage that extends into said body from a side thereof and extends on opposite sides of said tubular barrel, said fastener pin being positionable in said passage upon securement of the barrel to said body for rotatably orienting the barrel in predetermined angular relation to the body, and said pin-receiving passage being threaded on one side of said barrel for threaded engagement by said pin and retention thereof.

* * * * *